US008288695B2

(12) United States Patent
Nishijima et al.

(10) Patent No.: US 8,288,695 B2
(45) Date of Patent: Oct. 16, 2012

(54) COOKING DEVICE

(75) Inventors: Masahiro Nishijima, Gose (JP); Hiroki Kitayama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1259 days.

(21) Appl. No.: 12/066,046

(22) PCT Filed: Aug. 25, 2006

(86) PCT No.: PCT/JP2006/316697

§ 371 (c)(1),
(2), (4) Date: Mar. 6, 2008

(87) PCT Pub. No.: WO2007/029521

PCT Pub. Date: Mar. 15, 2007

(65) Prior Publication Data

US 2009/0134150 A1 May 28, 2009

(30) Foreign Application Priority Data

Sep. 8, 2005 (JP) ..... 2005-260016

(51) Int. Cl.
*H05B 6/76* (2006.01)
*H01P 11/00* (2006.01)

(52) U.S. Cl. ..... 219/756; 219/681; 219/738; 219/741; 29/600

(58) Field of Classification Search ..... 219/756, 219/679, 681, 741, 742, 739, 740, 722, 724; 126/200, 198, 190; 174/358, 370, 381, 35 R, 174/35 MS, 35 GC; 29/600, 460
See application file for complete search history.

(56) References Cited

U.S. PATENT DOCUMENTS

| | | | | |
|---|---|---|---|---|
| 4,102,041 | A * | 7/1978 | Copping et al. | 29/600 |
| 5,095,657 | A | 3/1992 | Marsh | |
| 5,615,859 | A * | 4/1997 | Haag, III | 251/61.1 |

FOREIGN PATENT DOCUMENTS

| | | | |
|---|---|---|---|
| DE | 199 35 836 | A1 | 2/2001 |
| DE | 101 31 009 | A1 | 1/2003 |
| EP | 1 535 551 | A1 | 6/2005 |
| JP | 58-175732 | A | 10/1983 |
| JP | 60-41912 | A | 3/1985 |
| JP | 2-178524 | A | 7/1990 |
| JP | 7-94272 | A | 4/1995 |
| JP | 8-124674 | A | 5/1996 |
| JP | 2000-30856 | A | 1/2000 |
| JP | 2001-355844 | A | 12/2001 |
| JP | 2003-109745 | A | 4/2003 |
| JP | 2003-243150 | A | 8/2003 |
| JP | 2004-321290 | A | 11/2004 |
| JP | 2007-115710 | A | 5/2007 |

* cited by examiner

*Primary Examiner* — Quang Van
(74) *Attorney, Agent, or Firm* — Birch, Stewart, Kolasch & Birch, LLP

(57) ABSTRACT

A cooking device for performing cooking using a microwave and steam, in which a door of a heating chamber includes, as constituting components, an inner frame, a choke cover, and a gasket. The inner frame is made of metal and has at its periphery a choke structure constructed from a large number of comb teeth. The gasket is installed in the door with a base section of the gasket held between the inner frame and the choke cover. A lip section of the gasket has a bag-like cross-section whose side that faces the inside of the heating chamber is an entrance. The forward end of the lip section is bent to the door side. The comb teeth, except those positioned at the corners of the door, are bent at a larger angle than in a case in which the gasket is not installed.

3 Claims, 6 Drawing Sheets

COOKING DEVICE

TECHNICAL FIELD

The present invention relates to a cooking device for performing cooking using a microwave and steam.

BACKGROUND ART

Household cooking devices using a microwave, so-called microwave ovens, have been commonly used. Nowadays, cooking devices using steam, especially superheated steam that is highly effective for removing fat and salt contained in food, are also common. There are two types of cooking devices using steam: those which use only steam for cooking and those which use a microwave and steam in combination.

Regardless of whether cooking is performed using a microwave or steam, leakage of a microwave and steam from a heating chamber may cause safety problems, and thus various measures have been taken to prevent such leakage. A measure commonly taken to prevent leakage of a microwave is to provide a choke structure as described in Patent Publications 1 to 4 (listed below). When a choke structure is provided at the door of a heating chamber, leakage is prevented relatively effectively at the sides of the door, but it is not easy to prevent leakage at the corners of the door. To cope with this, in the device described in Patent Publication 1, the choke provided at the four corners of the door is designed to have a particular longitudinal width. In the device described in Patent Publication 2, a slit-choke structure is provided in an area where an upper or a lower hinge overlaps the door body. In the device described in Patent Publication 3, the bending angle at which a bent section is bent is larger near a corner than at other locations. In the device described in Patent Publication 4, protruding surface sections located near the corners of the door are designed to protrude more than those in other locations. In order to prevent leakage of steam, a gasket is commonly used as described in Patent Publications 5 and 6.

[Patent Publication 1] JP-A-2003-243150 (Pages 2 to 4, FIGS. 1 and 2)

[Patent Publication 2] JP-A-2003-109745 (Pages 2 and 3, FIGS. 1 to 10)

[Patent Publication 3] JP-A-H8-124674 (Pages 3 and 4, FIGS. 1 to 4)

[Patent Publication 4] JP-A-H7-94272 (Pages 3 and 4, FIGS. 1 to 5)

[Patent Publication 5] JP-A-2000-30856 (Pages 2 and 3, FIGS. 1 to 4)

[Patent Publication 6] JP-A-H2-178524 (Page 2, FIGS. 1 to 5)

DISCLOSURE OF THE INVENTION

Problems to be Solved by the Invention

In order to cook using a microwave and steam in combination, it is necessary to effectively prevent leakage of the microwave and steam. An object of the present invention is to provide a cooking device where such necessity is fulfilled.

Means for Solving the Problem

To achieve the above object, according to the present invention, in a cooking device using a microwave and steam in combination, a door of a heating chamber is provided with: a choke structure that prevents leakage of the microwave from the heating chamber; and a gasket that is fitted near the choke structure with a choke cover for covering the choke structure and prevents leakage of the steam from the heating chamber, and a lip section of the gasket is designed to have a bag like cross section in which an opening is formed on a side thereof that faces an inside of the heating chamber, an end of the lip section in the bag-like cross section being bent toward the door.

With this structure, steam pressure inside the heating chamber acts so as to inflate the bag-like cross section of the gasket, and thus the sealing function of the gasket is improved with an increase in steam pressure.

Furthermore, the following advantage results from bending the end of the lip section of the gasket in its bag-like cross section toward the door.

That is airtightness is not impaired even if the edge of the lip section is deformed by heat, because it is not the edge of the lip section but the portion thereof corresponding to the middle portion of the bag-like cross section that mainly serves to cut off the gas flow by being tightly pressed against a wall.

A bending angle of metal comb teeth constituting the choke structure may be larger than in a case where the gasket is not installed, leaving metal comb teeth located at corners of the door as an exception.

The phase of a microwave shifts when a gasket is provided near a choke structure, and thus conventional choke structures normally cannot prevent leakage of a microwave. However, the function to prevent leakage of a microwave can be maintained effective by making the bending angle at which the comb teeth are bent larger than in the case where no gasket is installed. Here, making the bending angle larger adversely affects the comb teeth located at the corners of the door; however, this can be coped with by making the bending angle of such comb teeth, as an exception, not larger.

The exception of the bending angle may be limited to comb teeth located near metal hinge assemblies of the door among those located at the corners of the door.

Among the comb teeth located at the corners of the door, it is those located near the metal hinge assemblies that are adversely affected, with respect to the function to prevent leakage of a microwave, by being bent at a larger angle. Therefore, only the bending angle of such comb teeth is made different from that of the other comb teeth, and this helps facilitate the fabrication process of the choke structure.

Advantages of the Invention

According to the present invention, leakage of a microwave and steam can be prevented by a choke structure and a gasket. Moreover, since the lip section of the gasket has a bag-like cross section in which an opening is formed on the side thereof that faces the inside of the heating chamber, the bag-like cross section is inflated with an increase in steam pressure inside the heating chamber, and this enhances the sealing function of the gasket. Furthermore, since the edge of the lip section of the gasket is bent toward the door, it is not the edge of the lip section but the portion thereof corresponding to the middle portion of the bag-like cross section; thus, airtightness is not impaired even if the edge of the lip section is deformed by heat.

LIST OF REFERENCE SYMBOLS

Figure 1:
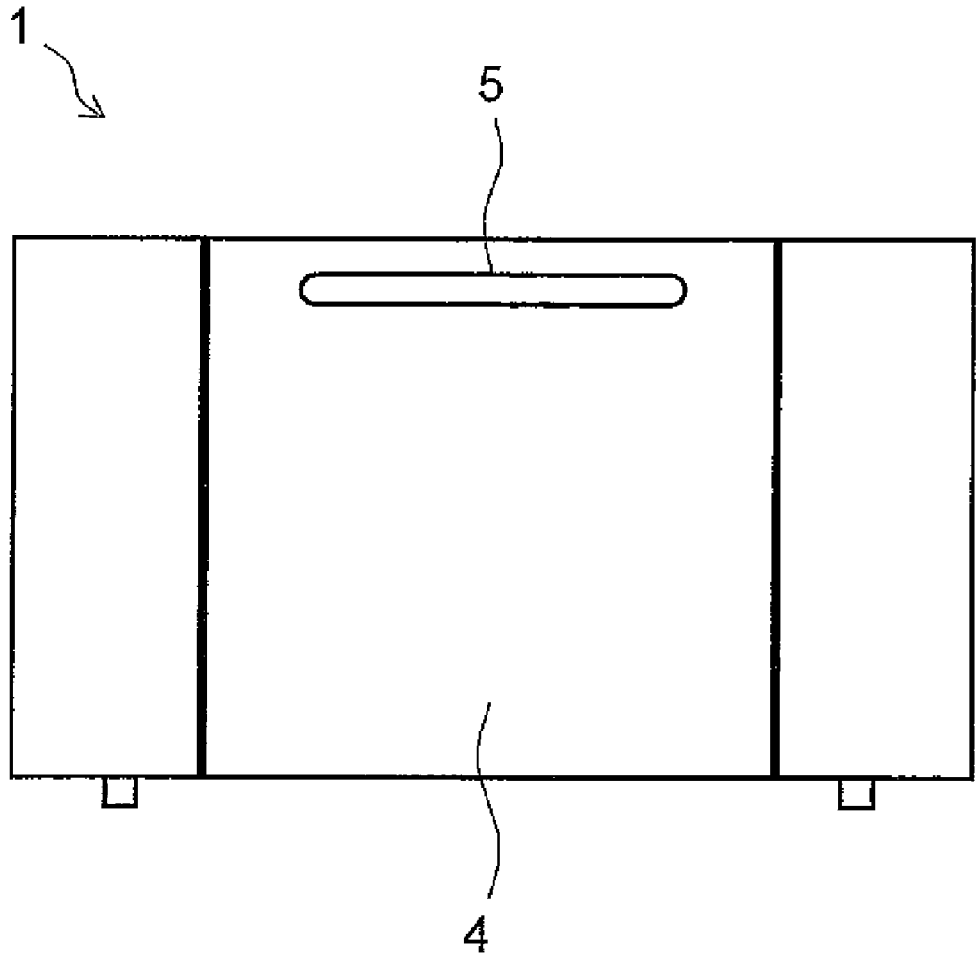
FIG. 1 is a front view of a cooking device.

1 cooking device
2 cabinet
3 heating chamber
4 door
5 handle
10 inner frame
12 choke structure
13, 13*a* comb teeth
20 choke cover
30 gasket
32 lip section

BEST MODE FOR CARRYING OUT THE INVENTION

Figure 2:
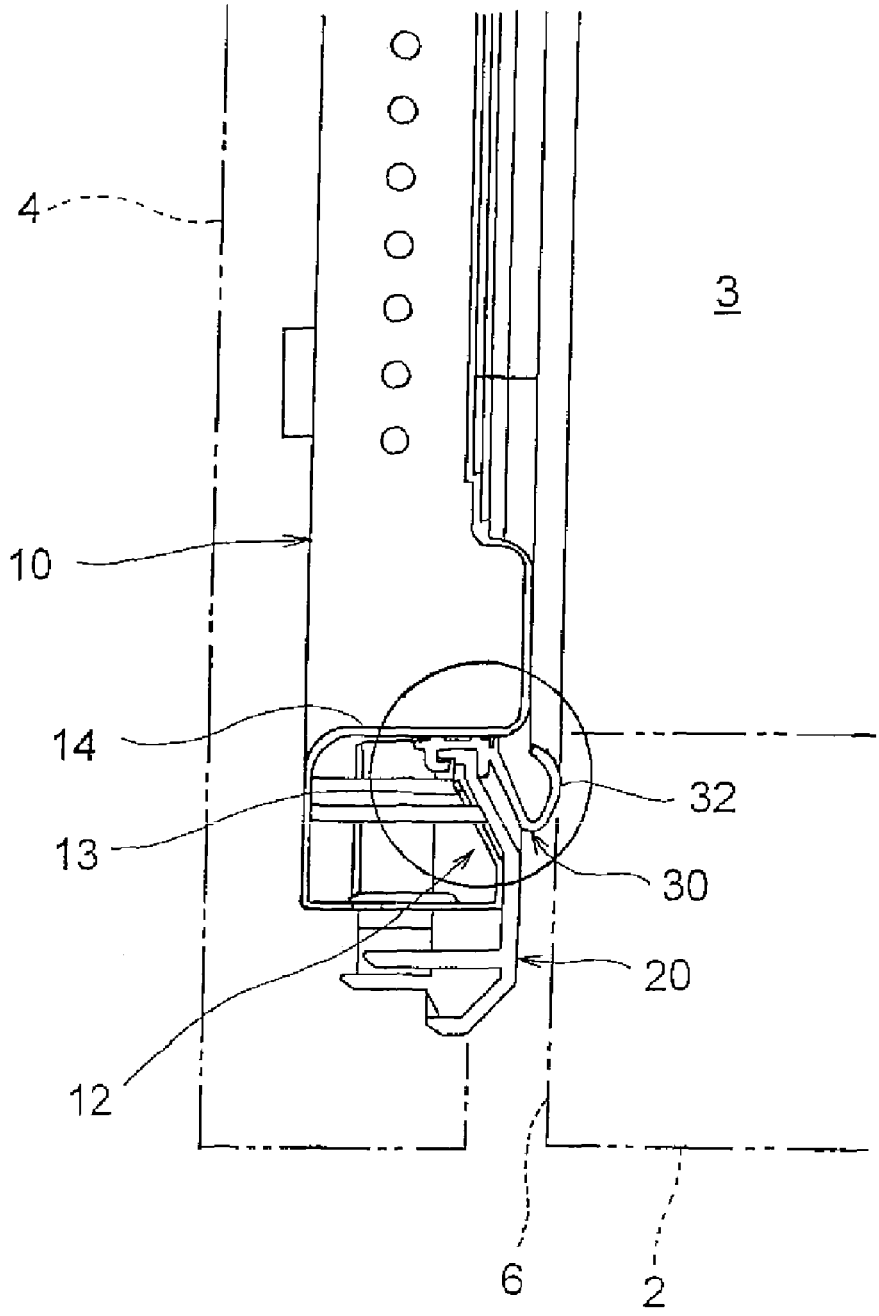
FIG. 2 is a partial sectional view of a heating chamber door.

A description will be given below of an embodiment of the present invention with reference to the accompanying figures. A cooking device 1 includes a microwave generator and a steam generator (neither shown), and is capable of cooking by: using only a microwave, using only steam, and using a microwave and steam in combination. The cooking device 1 has a heating chamber 3 formed inside a cabinet 2 (see FIG. 2) and a door provided in the front center of the cabinet 2 so as to cover an opening of the heating chamber 3. The door 4 rotates in a vertical plane around a hinge section (not shown) provided at the bottom end thereof, and has a handle 5 provided at the front top thereof.

The door 4 is composed of many components, among which the following three components should be noted: an inner frame 10, a choke cover 20, and a gasket 30.

The inner frame 10 is formed by pressing a metal plate (more specifically, a steel plate) into a frame shape, and to a window 11 in the center of the inner frame 10, there are fitted a punched metal plate, a glass plate, etc. so as to prevent leakage of the microwave while permitting the inside of the heating chamber to be visible. At the periphery of the inner frame 10, a choke structure 12 is formed to prevent leakage of a microwave. The choke structure 12 is built by forming along the edge of a metal plate a large number of comb teeth 13 having a predetermined size and arranged at predetermined intervals, and bending these comb teeth 13 at a predetermined angle. The end of each of the comb teeth 13 faces the outer surface of an inner protruding wall 14 formed in the inner frame 10, with a predetermined distance between the ends and the outer surface.

Figure 3:
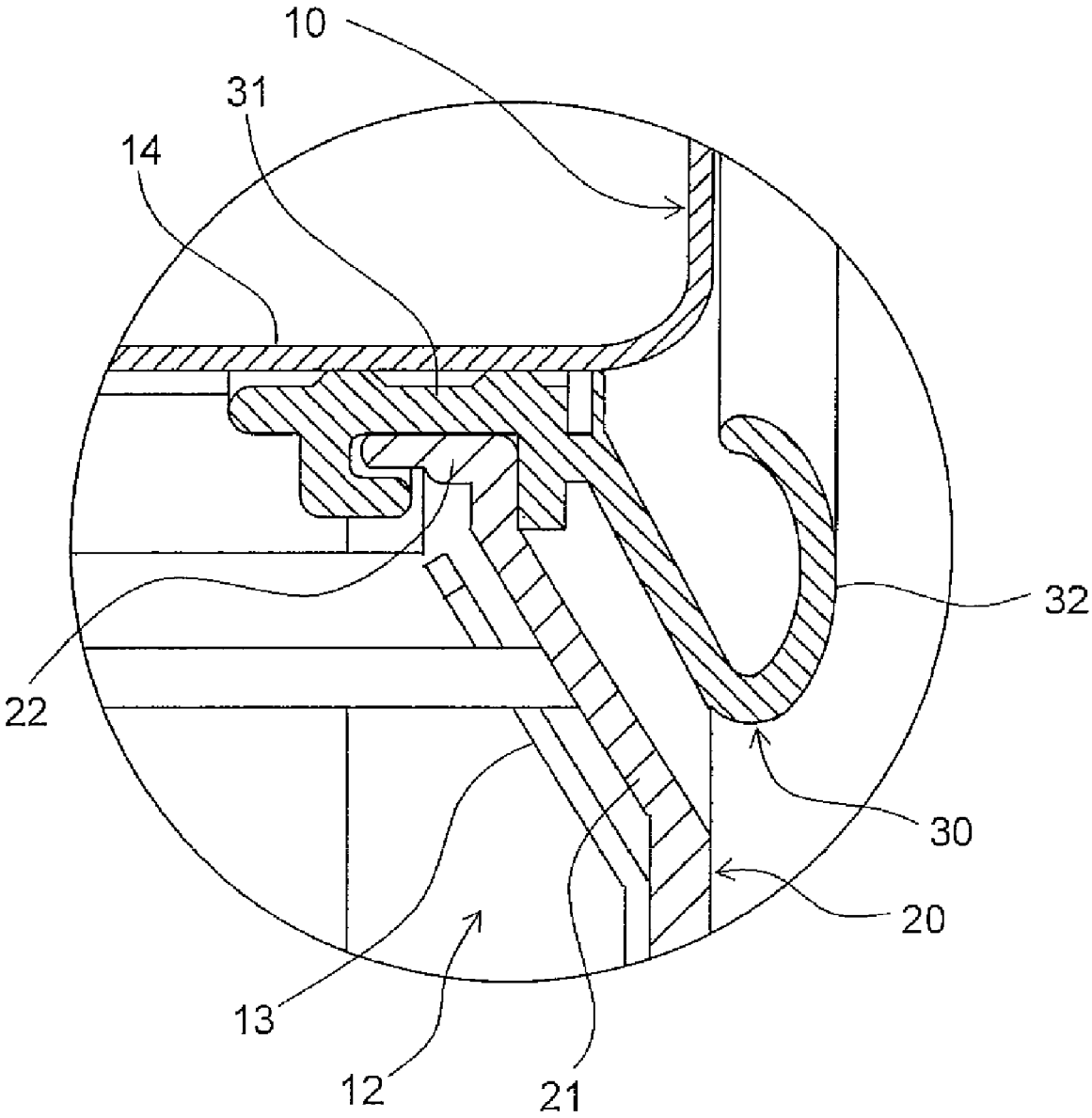
FIG. 3 is a partially enlarged view of the encircled area of FIG. 2.

A choke cover 20, a resin product molded in a frame shape, encloses the inner frame 10. The choke cover 20 includes a wall 21 (see FIG. 3) that is formed to be in parallel with the comb teeth 13, and an inner edge section 22 that continues from the wall 21 faces the inner protruding wall 14 with a predetermined gap therebetween.

A gasket 30 is a product of a highly heat-resistant flexible synthetic resin molded by extrusion molding, and is built by forming the following sections so as to be continuous to each other: a lip section 32 that is tightly pressed against a wall 6 around the opening of the heating chamber 3; and a base section 31 (see FIG. 3) that covers the inner edge section 22 of the choke cover 20. The lip section 32 has a bag-like cross section in which an opening is formed on the side thereof that faces the inside of the heating chamber 3. An edge of the lip section 32 is bent toward the door 4, and this makes the bag-like cross section thereof appear to be a bag with its mouth narrowed.

When the choke cover 20 is fit to the inner frame 10 with the inner edge section 22 thereof covered with the base section 31 of the gasket 30, the base section 31 is pushed into the gap between the inner edge section 22 and the inner protruding wall 14 so as to tightly close the gap. This prevents steam from entering the space between the inner frame 10 and the choke cover 20. When the inner frame 10 and the choke cover 20 connected to each other with the gasket 30 is engaged with other components of the door 4, the installation of the gasket 30 is completed.

When steam pressure inside the heating chamber 3 rises, the pressure acts so as to inflate the bag-like cross section of the lip section 32, and thereby the lip section 32 is pressed more tightly against the wall 6. Thus, the sealing function of the gasket 30 is improved with an increase in steam pressure. The edge of the lip section 32 is bent toward the door 4, and thus it is not the edge of the lip section 32 but the portion thereof corresponding to the middle portion of its bag-like cross section that is tightly pressed against the wall 6 and mainly serves to cut off gas flow. Therefore, airtightness is not impaired even if the edge of the lip section 32 is deformed by heat to be, for example, wavy.

Since the gasket 30 is fitted near the choke structure 12, the phase of the microwave headed for the choke structure 12 is shifted. Hence, if the angle at which the comb teeth 13 are bent is left as it is in the case where the gasket 30 is not provided, leakage of the microwave cannot be prevented. To cope with this, the bending angle at which the comb teeth 13 are bent is adjusted such that the function to prevent leakage of a microwave is maintained effective.

Figure 6:
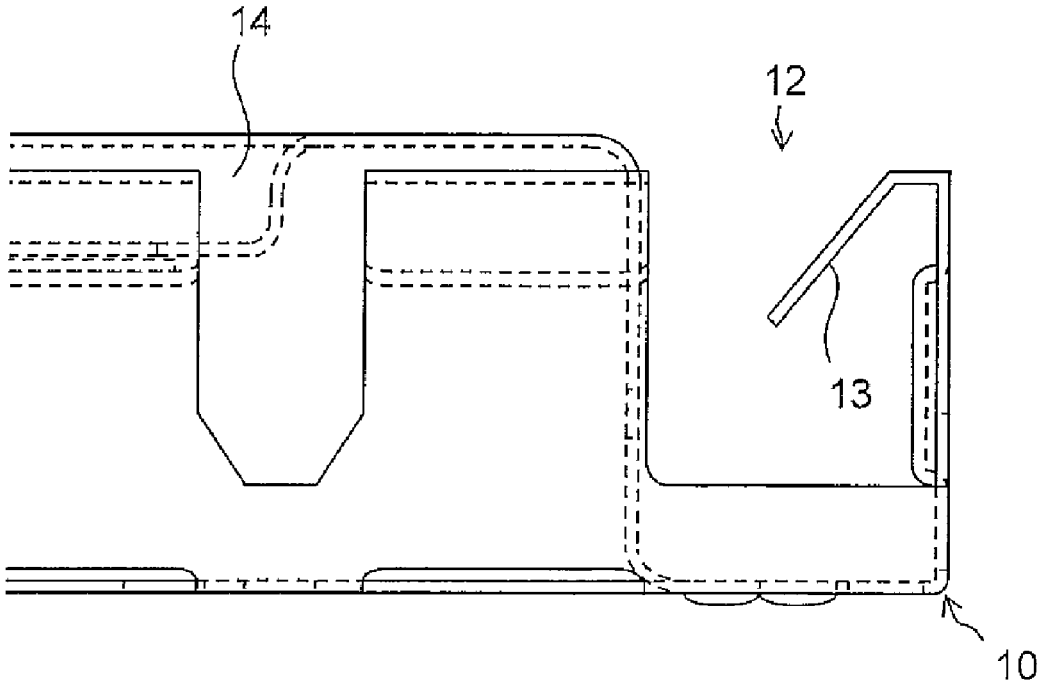
FIG. 6 is a partially enlarged view of the choke structure.

More specifically, the bending angle at which the comb teeth 13 are bent is made larger. FIG. 6 shows the comb teeth 13 bent at a larger bending angle, and the comb teeth 13 form an angle of approximately 45° with respect to the front surface of the inner frame 10. This enables the comb teeth 13 to restore its function to prevent leakage of the microwave.

Figure 4:
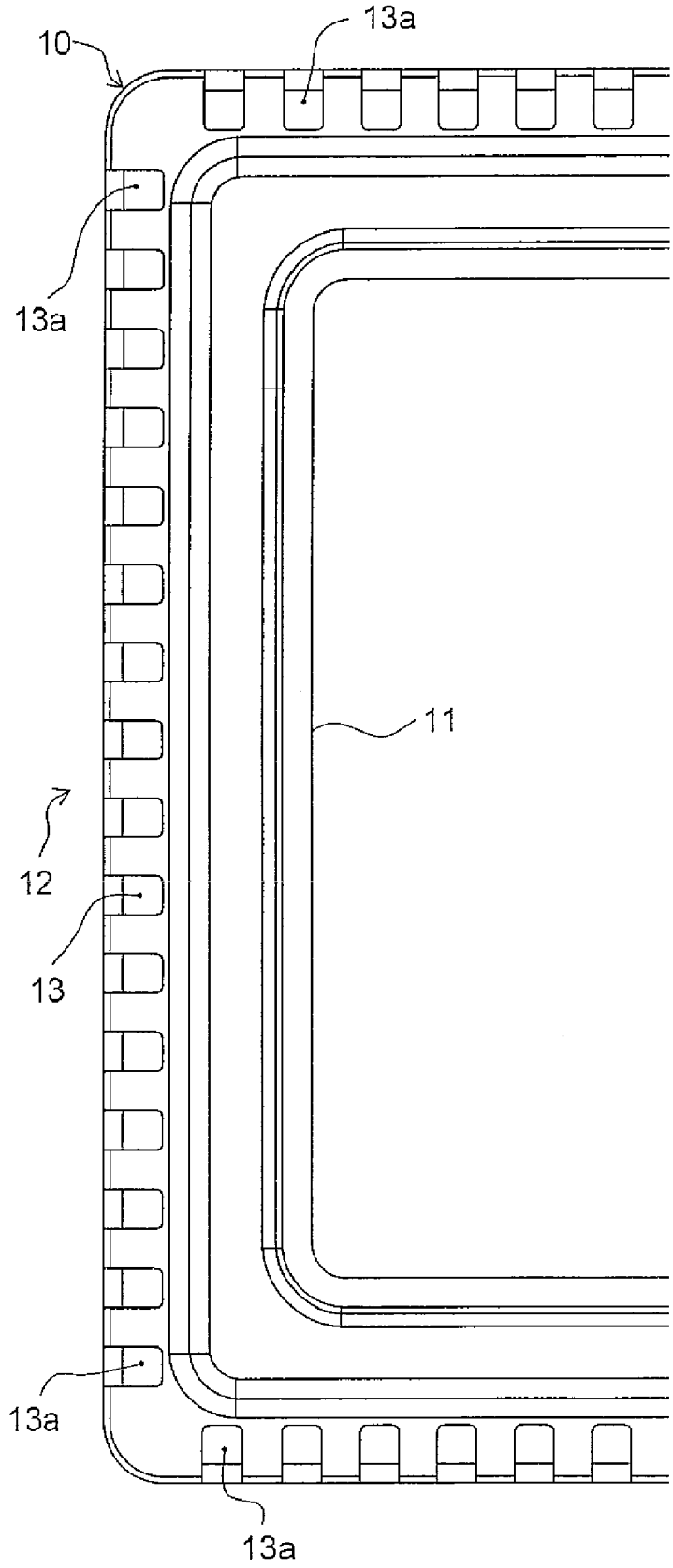
FIG. 4 is a partial front view showing a choke structure.
Figure 5:
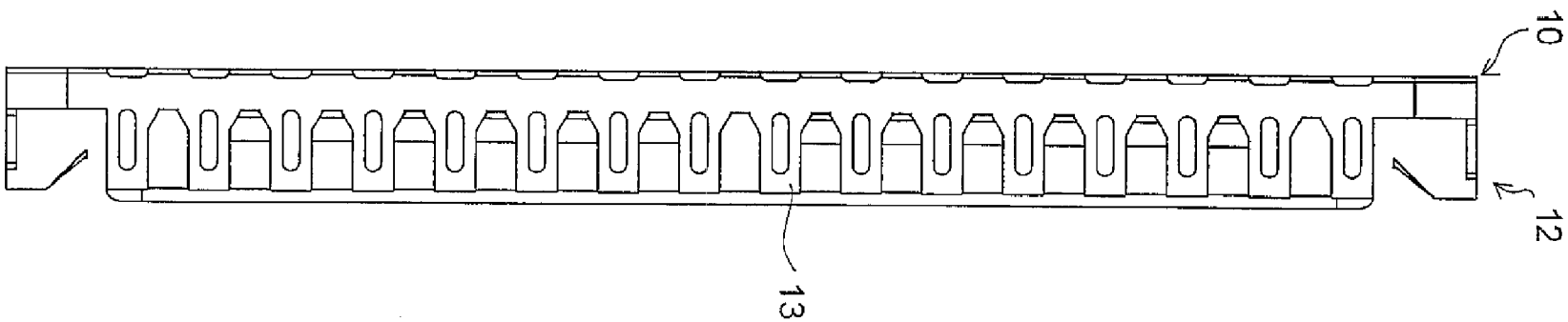
FIG. 5 is a side view of the choke structure.
Figure 7:
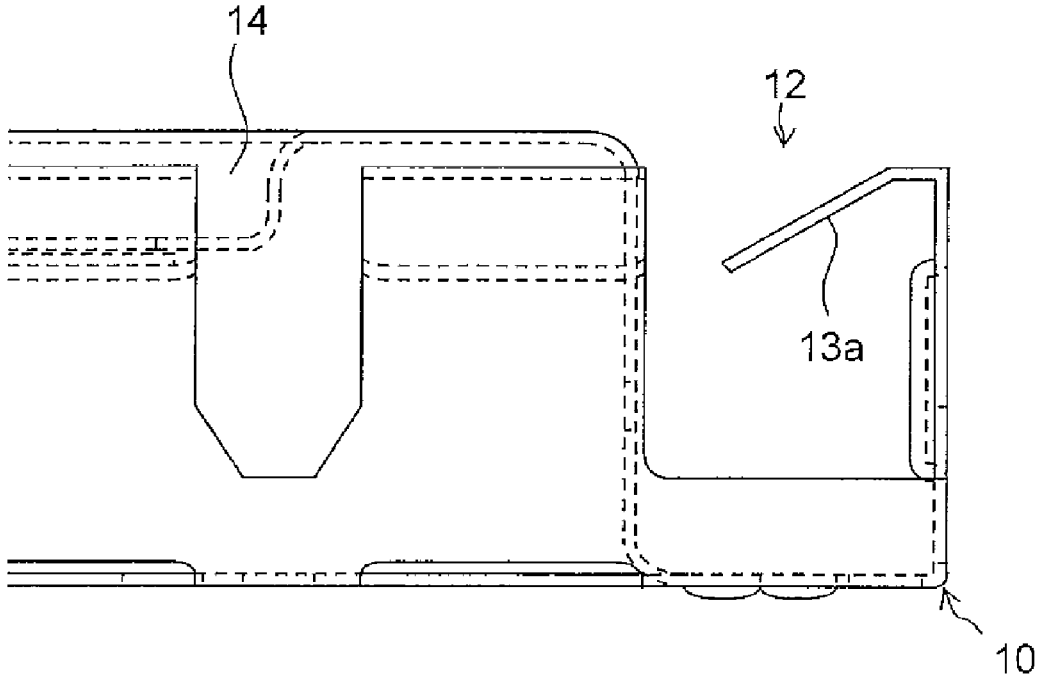
FIG. 7 is a partially enlarged view of the choke structure showing another portion thereof.

However, bending the comb teeth 13 at a larger angle is not effective to all the comb teeth 13. As for the comb teeth located at the corners of the door 4, that is, the pairs of comb teeth denoted by reference numeral 13*a* in FIG. 4, if they are bent at a larger angle, the shortest distance between the ends of each pair of the comb teeth 13*a* becomes longer, and this deprives the comb teeth 13*a* of the function to prevent leakage of a microwave. To prevent this from happening, the comb teeth 13*a* arranged next to each other are bent not at a bending angle larger than conventional but at a conventional bending angle. FIG. 7 shows such a comb tooth 13*a*. The comb teeth 13*a* form an angle of approximately 30° with respect to the front surface of the inner frame 10.

Bending the comb teeth 13*a* at a bending angle different from that for the comb teeth 13 is remarkably effective in the case where the comb teeth 13*a* are located near the metal hinge assemblies (not shown) of the door 4; in contrast, it is not so effective in the case where the comb teeth 13*a* are not located near the metal hinge assemblies. Hence, among the comb teeth 13*a*, only those located near the metal hinge assemblies, more specifically those located at the two bottom corners of the door 4, may be bent at a bending angle different from that for the comb teeth 13. This helps facilitate the fabrication of the choke structure 12.

Although a description has been given of the embodiment of the present invention, this embodiment is only an example and does not limit the present invention in any way. It should be understood that the scope of the present invention is defined not by the embodiment but by the attached claims, and includes all modifications and variations that fall within the scope of the attached claims and equivalents thereof.

INDUSTRIAL APPLICABILITY

The present invention is widely applicable to cooking devices for performing cooking using a microwave and steam in combination.

The invention claimed is:

1. A cooking device using steam for cooking and having a heating chamber for cooking, wherein a door of a heating chamber is provided with a gasket preventing leakage of steam from the heating chamber; and a lip section of the gasket has a bag-like cross section in which an opening is formed on a side thereof that faces an inside of the heating chamber, an end of the lip section in the bag-like cross section being bent toward the door so that steam pressure acts on the opening to inflate the bag-like cross section and press the gasket against a wall around an opening of the heating chamber.

2. The cooking device of claim 1, wherein the cooking device uses microwaves for cooking;

the door of the cooking chamber is provided with a choke structure preventing leakage of microwaves from the heating chamber and a choke cover covering the choke structure;

the gasket is fitted near the choke structure; and the lip section of the gasket extends from a space between the choke cover and the door.

3. The cooking device of claim 1, wherein the lip section of the gasket has a shape that appears to be a bag having a mouth thereof narrowed.

* * * * *